US005954622A

United States Patent [19]

Olschansky et al.

[11] Patent Number: 5,954,622

[45] Date of Patent: Sep. 21, 1999

[54] GLUTEAL EXERCISE SYSTEM

[76] Inventors: Scott Olschansky; Brad Olschansky, both of 2003 Lake Park Dr., Apt. H, Smyrna, Ga. 30080

[21] Appl. No.: 09/013,310

[22] Filed: Jan. 26, 1998

[51] Int. Cl.[6] ..... A63B 21/02

[52] U.S. Cl. ..... 482/123; 482/126; 482/129; 482/133; 482/908

[58] Field of Search ..... 482/121–123, 482/125, 126, 129, 130, 133, 134, 139, 140, 148, 907, 908

[56] References Cited

U.S. PATENT DOCUMENTS

| | | | |
|---|---|---|---|
| 1,023,756 | 4/1912 | Pons | 482/128 |
| 2,106,994 | 2/1938 | Chapman | 482/126 |
| 4,351,527 | 9/1982 | Crisp, Jr. | 482/121 |
| 4,591,150 | 5/1986 | Mosher | 482/125 |
| 5,069,448 | 12/1991 | Shyu | 482/140 |
| 5,152,732 | 10/1992 | Sayre | 482/128 |
| 5,232,425 | 8/1993 | Miller et al. | 482/121 |
| 5,637,066 | 6/1997 | Chang | 482/126 |
| 5,795,275 | 8/1998 | Van Der Hoeven et al. | 482/122 |

FOREIGN PATENT DOCUMENTS

| | | | |
|---|---|---|---|
| 30512 | 6/1981 | European Pat. Off. | 482/122 |

*Primary Examiner*—Jeanne M. Clark
*Attorney, Agent, or Firm*—Rosenberg, Klein & Bilker

[57] ABSTRACT

A gluteal exercise system (10) for imparting a resistive force responsive to a displacement force applied by a user (1) is provided. The gluteal exercise system (10) includes a lower body section (100) having a lower coupling portion (110) and a pair of engagement bars (120, 120') for concurrently engaging the feet of the user (1). The gluteal exercise system (10) also includes an upper body section (200) which is displaceably coupled to the lower body section (100). The upper body section (200) is formed with an upper coupling portion (210) and a pair of engagement arms (220, 220') extending transversely therefrom for concurrently engaging portions of the legs of the user (1). The gluteal exercise system (10) also includes a tension mechanism adjustably coupled to the lower and upper coupling portions (110, 210) for imparting the resistive force in opposition to the force imparted by the user (1) to displace the upper body section (200) relative to the lower body section (100). The upper and lower coupling portions (210, 110) are preferably coupled in telescoped manner; and, the tension mechanism is preferably realized as an elastic band member (300) coupled to one of a plurality of hook members formed on the upper coupling portion (210) and a hook member coupled to the lower coupling portion (110).

7 Claims, 5 Drawing Sheets

GLUTEAL EXERCISE SYSTEM

BACKGROUND OF THE INVENTION

1. Field of the Invention

This invention is directed to a simply constructed and adaptable exercise system. More specifically, this invention is directed to an exercise system readily adaptable to suit a user's physical condition and unique bodily dimensions.

The extent to which the general public values physical fitness is indicated, among other things, by the proliferation of exercise machines and devices presently available on the market. Such machines and devices vary greatly in form and function. They can nevertheless be grouped somewhat generally into: (1) equipment designed to stimulate and stress the user's entire body for calorie-burning aerobic exercises, and (2) equipment designed to strengthen and tone specific muscles or muscular regions of the user's body.

2. Prior Art

Within the class of equipment designed to strengthen and tone the user's body, a wide array of machines and devices are known and available. From multi-station home gym machines to simple, versatile multi-exercise devices such as that disclosed in U.S. Pat. No. 5,603,681 issued to Applicants; equipment of the type which generates a resistive force when a displacement force is imparted thereon by certain muscles or muscle regions of the user's body are well known in the prior art. There are, however, few if any machines or devices intended specifically to isolate and acutely exercise the muscles in the user's gluteal region.

Although many of the known machines and devices necessarily invoke the exercise of the user's gluteal muscles during their use, they do so only as a byproduct of their primary intended function. Even in those cases where exercise of the user's gluteal muscles is, indeed, the primary function intended, the prior art has failed to adequately isolate the gluteal muscles for exercise, allowing the undesirable contribution of other muscles to the exercise performed. This greatly diminishes the efficiency of the exercise for those with limited time and energy to devote to exercising, who nonetheless wish to rapidly strengthen and tone their gluteal muscles.

The efficiency of exercise provided by a particular machine or device does not depend on its functional design alone. It depends also on the degree to which that machine or device conforms to the physical traits of the given user. For instance, the machine or device would be of limited utility, if any, were it not adequately dimensioned to accommodate the length of the user's limbs. Similarly, the machine or device would be of limited utility, if any, were the magnitude of resistive force it applied responsive to the user's exertion of force either too great to permit the user to effect the full range of required exercise movement, or too low to offer any form of meaningful resistance during that exercise movement.

Thus, there is a need for an exercise system that effectively isolates and exercises the muscles in the gluteal region of a user's body. There is also the need for the device to be readily adjustable so as to be quickly and conveniently adaptable to the unique physical traits of the given user.

SUMMARY OF THE INVENTION

An object of the present invention is to provide an exercise system for exercising the muscles in the gluteal region of a user's body.

Another object of the present invention is to provide an exercise system that is simple in design yet is readily adjustable to conform both to the bodily dimensions of the given user and to the degree of resistance required by that particular user for meaningful exercise of his or her gluteal muscles.

Yet another object of the present invention is to provide an exercise device which is extremely portable.

Still another object of the present invention is to provide an exercise device which smoothly guides the user's exercise movements throughout the required range of movement.

These and other objectives are attained by the gluteal exercise system of the present invention. The subject gluteal exercise system generally includes a first body section having a first coupling portion and an engagement mechanism extending therefrom for concurrently engaging the user's feet; and a second body section displacably coupled to the first body section. The second body section is formed with a second coupling portion and an engagement mechanism extending therefrom for concurrently engaging portions of the user's legs. The gluteal exercise system further includes a tension mechanism that is adjustably coupled to both the first and second coupling portions for imparting a resistive force in opposition to a force imparted by a user to displace the first and second body sections relative to one another.

In a preferred embodiment, the subject gluteal exercise system is a portable device, and at least one hook member is formed on each of the first and second body sections. The tension mechanism is realized as an elastic member releasably connected between a first body section hook member and a second body section hook member.

The first coupling portion on the first body section is preferably formed as a substantially tubular sleeve member within which the second coupling portion of the second body section is telescopically received. The sleeve member has formed therein an access slot through which one or more of the hook members of the second body section is selectively accessible.

Adjustability in the resistive tension maintained over the desired range of relative displacement of the first and second body sections may be provided by forming a plurality of hook members on one or both of the body sections. The elastic tension member may then be selectively coupled between various first and second body member pairs. Alternatively, adjustability may be provided simply by making available at least one additional elastic tension member of differing dimension and/or elasticity with which to replace an existing elastic tension member.

DESCRIPTION OF THE PREFERRED EMBODIMENTS

Figure 1:
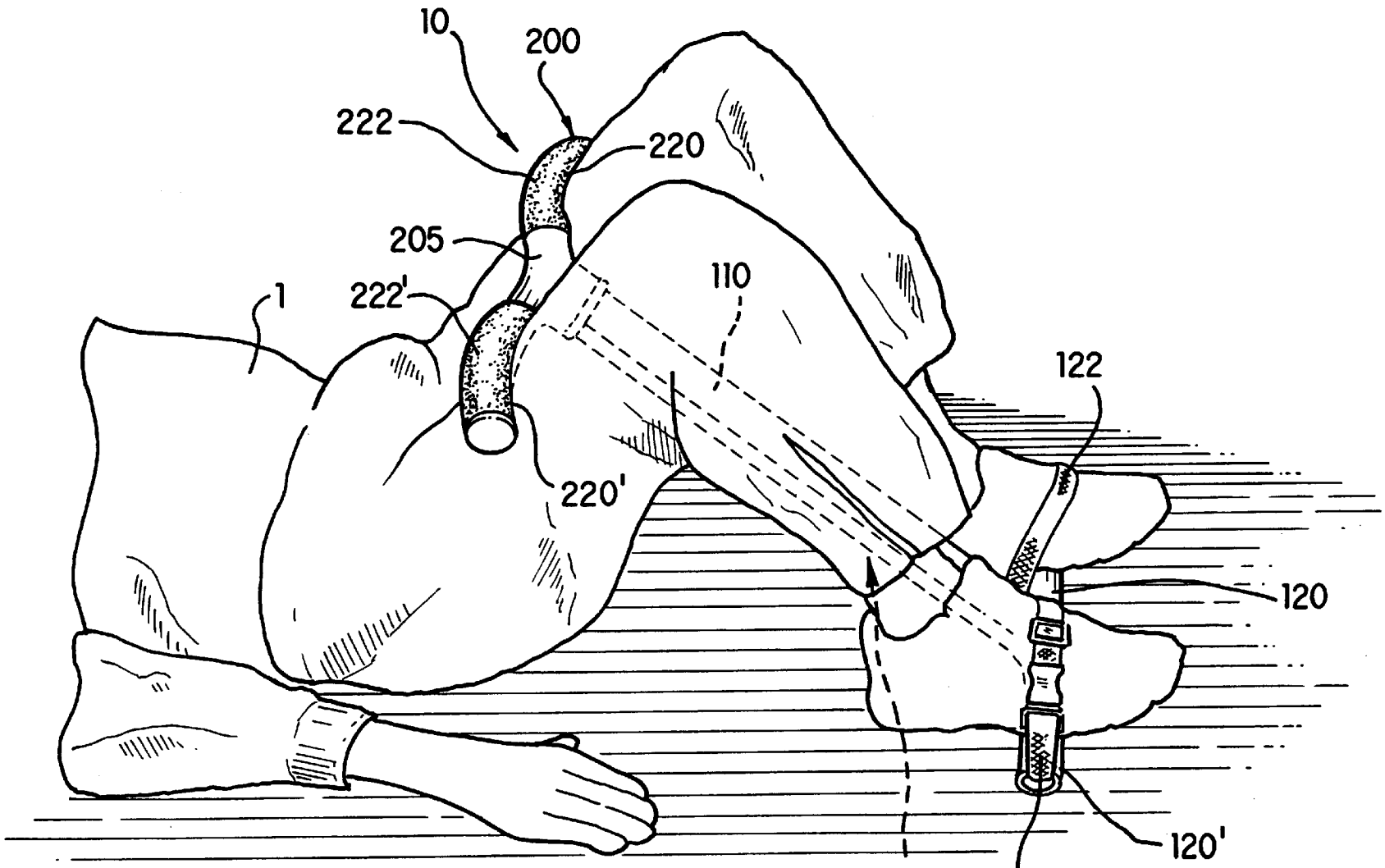
FIG. 1 is a perspective view, partially cut away, of the preferred embodiment of the present invention shown at one point in time during its typical use by a user.
Figure 2:
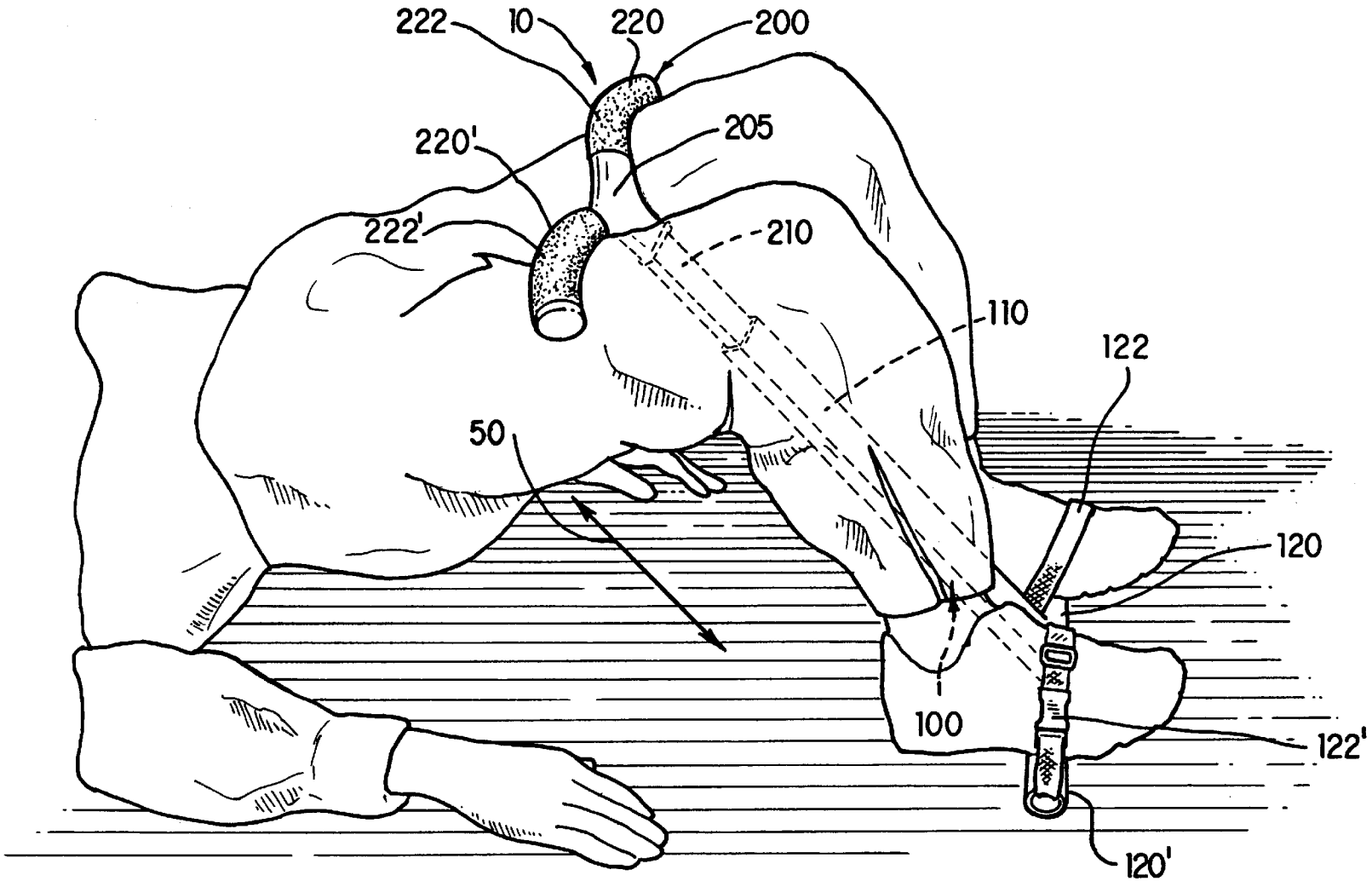
FIG. 2 is a perspective view, partially cut away, of the preferred embodiment of the present invention shown in FIG. 1 at a second point in time during its typical use by a user.

Referring now to FIGS. 1-2, there is shown gluteal exercise system 10 which generally includes lower body section 100 and upper body section 200 which are coupled in telescopically displaceable relation such that they are linear displaceable relative to one another. The lower body section 100 is formed with an elongate tubular sleeve 110 defining an inner space open at an upper end and a pair of foot engagement bars 120, 120' transversely extending therefrom. Upper body section 200 is formed with an elongate coupling portion 210 having the appropriate dimensions and sectional contour to ensure a fit within the tubular sleeve 110 that is sufficiently snug to prevent excessive lateral movement within that tubular sleeve 110, but with sufficient tolerance to prevent the generation of excessive frictional engagement force during its telescopic displacement. Extending transversely from the upper end of the coupling portion 210 are a pair of arcuate engagement arms 220, 220' which are dimensioned and shaped to comfortably engage the thighs of the user 1 during use.

Preferably, the engagement arms 220, 220' are integrally formed with respect to and branch from central portion 205 of the upper body section 200. Arms 220, 220' along with all other structural portions of the upper body section 200 are formed of steel, aluminum, plastic, or other like material of comparable strength, rigidity, and durability sufficient to accept the applied loads during operation. Given the resulting rigidity of the engagement arms 220, 220', they are respectively covered with cushioning sleeves 222, 222' formed of a foam or any other suitably resilient material for the user's comfort. Like the structural portions of the upper body section 200, all structural portions of the lower body section 100 are preferably formed of steel, aluminum, plastic, or other suitable material of comparable strength, rigidity, and durability to ensure operability.

Foot engagement bars 120, 120' extending from the lower end of the tubular sleeve member 110 are preferably formed by a tubular member of sufficient length to extend through the base portion 105 (FIG. 3) of sleeve member 110. A pair of foot clasping loop portions 122, 122' are formed in self-centering and adjustable manner by passing a flexible strap axially through the tube and coupling together the respective ends by use of a suitably adjustable fastening mechanism. For secure delineation of the loop portions 122, 122', the strap may be passed through a clip (not shown) or other anchoring mechanism optionally formed on the base portion 105. It should be recognized that while the loop portions 122, 122' aid in retaining the engagement of the user's feet with the foot bars 120, 120', the presence or particular form of such loop portions 122, 122' is not essential to the preferred embodiment of the present invention.

In operation, the coupling portion 210 of the upper body section 200 is partially withdrawn from the sleeve member 110 of the lower body section 100 (held in place by the user's feet) when user 1 lifts his or her pelvis from the underlying surface in the direction indicated by the bidirectional arrows 50. The coupling portion 210 is then reinserted into the sleeve member 110 when user 1 returns his or her pelvis along the bidirectional arrows 50 back to its rest position on the underlying surface.

The telescoped coupling portions 110, 210 are formed preferably with a rectangular cross sectional contour in order to minimize any pivotal or rotational displacement of the upper body section 200 relative to the lower body section 100 about their common displacement axis. Preference to a rectangular sectional contour is given due to such a contour offering stable guiding support during telescoping displacement. Other sectional contours may be freely employed so long as it does not disrupt the relative telescopic displacements of the body sections 100, 200.

Figure 3:
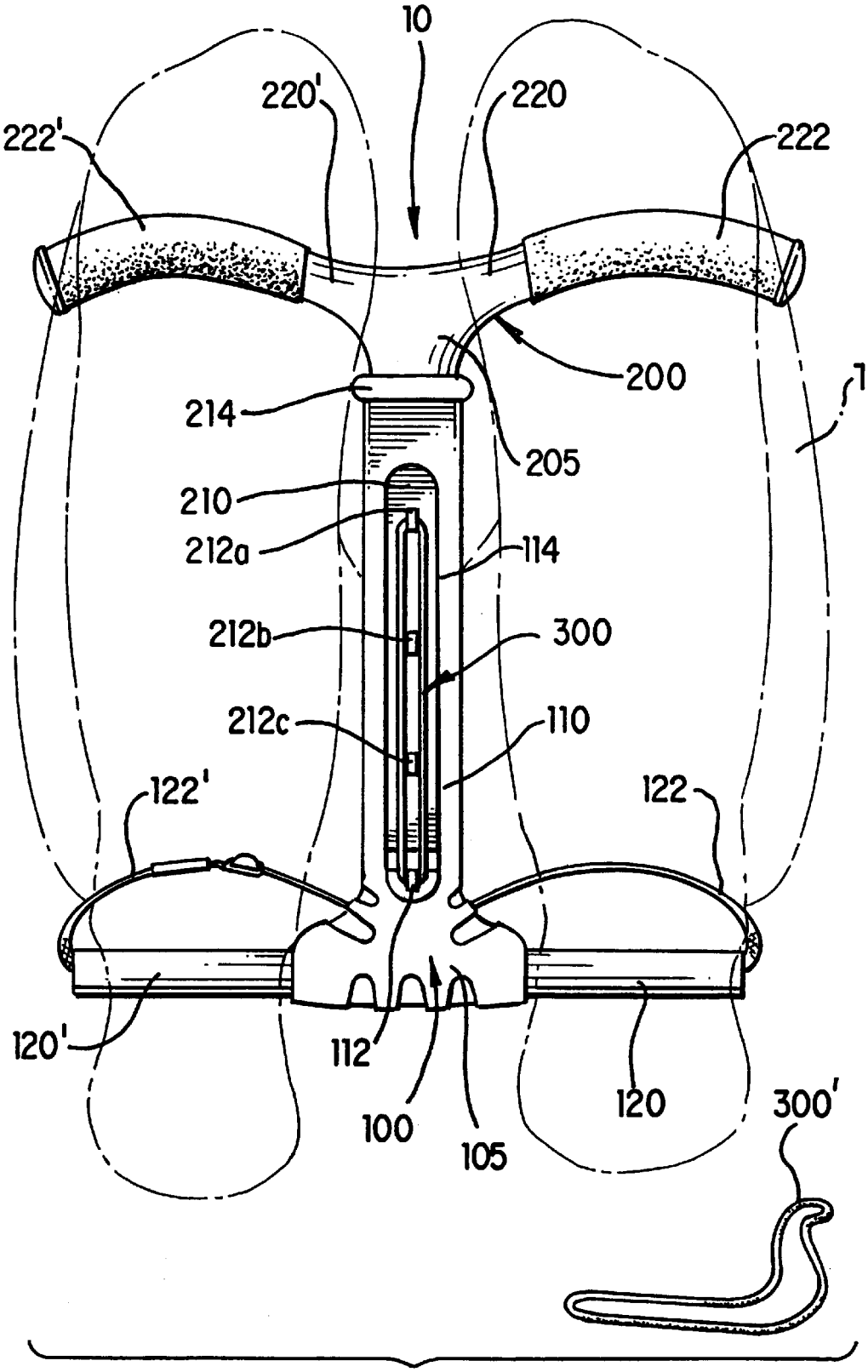
FIG. 3 is an elevational view of the preferred embodiment as it is shown in FIG. 1.
Figure 4:
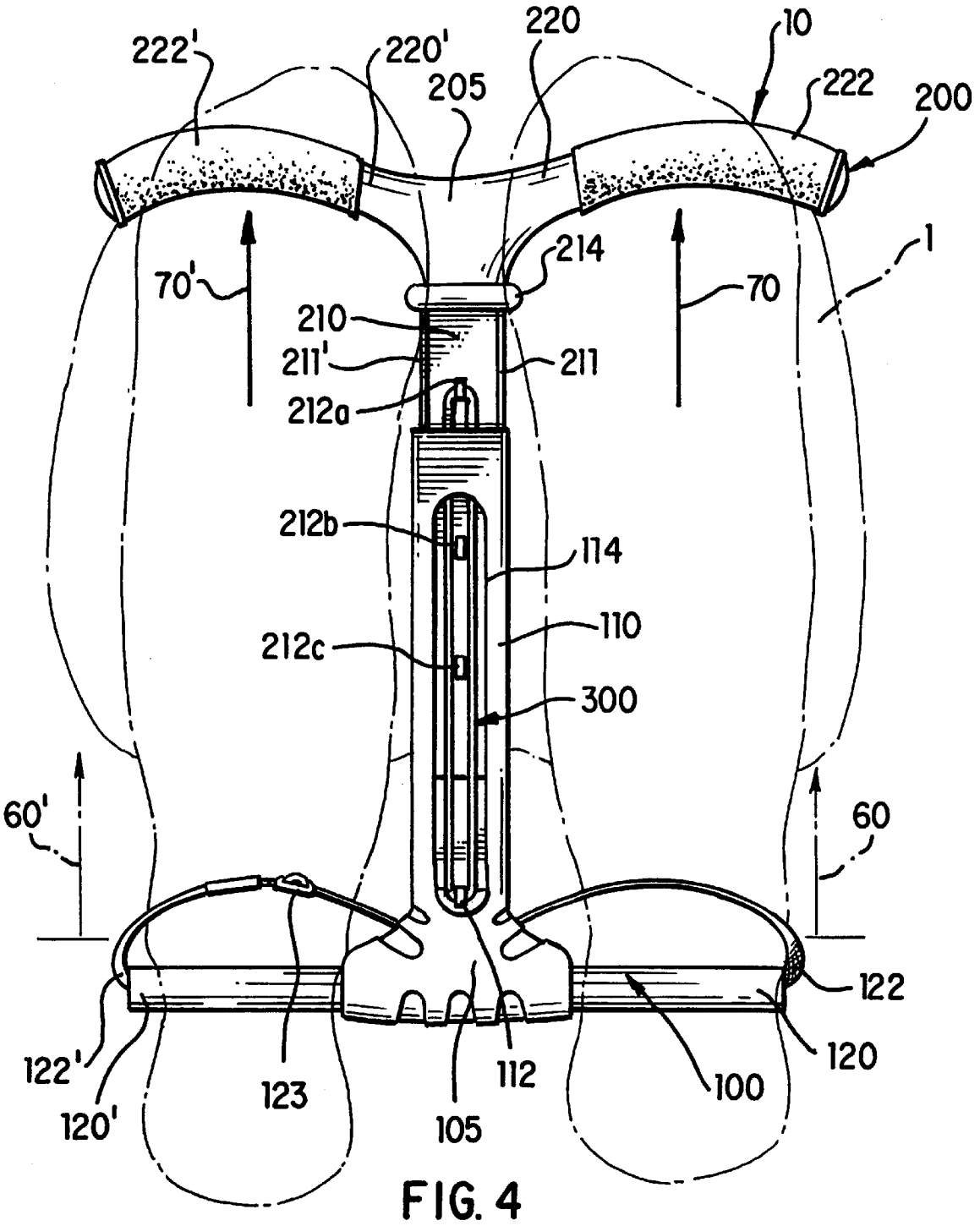
FIG. 4 is an elevational view of the preferred embodiment of the present invention as it is shown in FIG. 2; and, FIG. 5 is a closeup elevational view, partially cut away, of the coupling and tension mechanisms in the preferred embodiment of the present invention shown in FIGS. 1–4.
Figure 5:
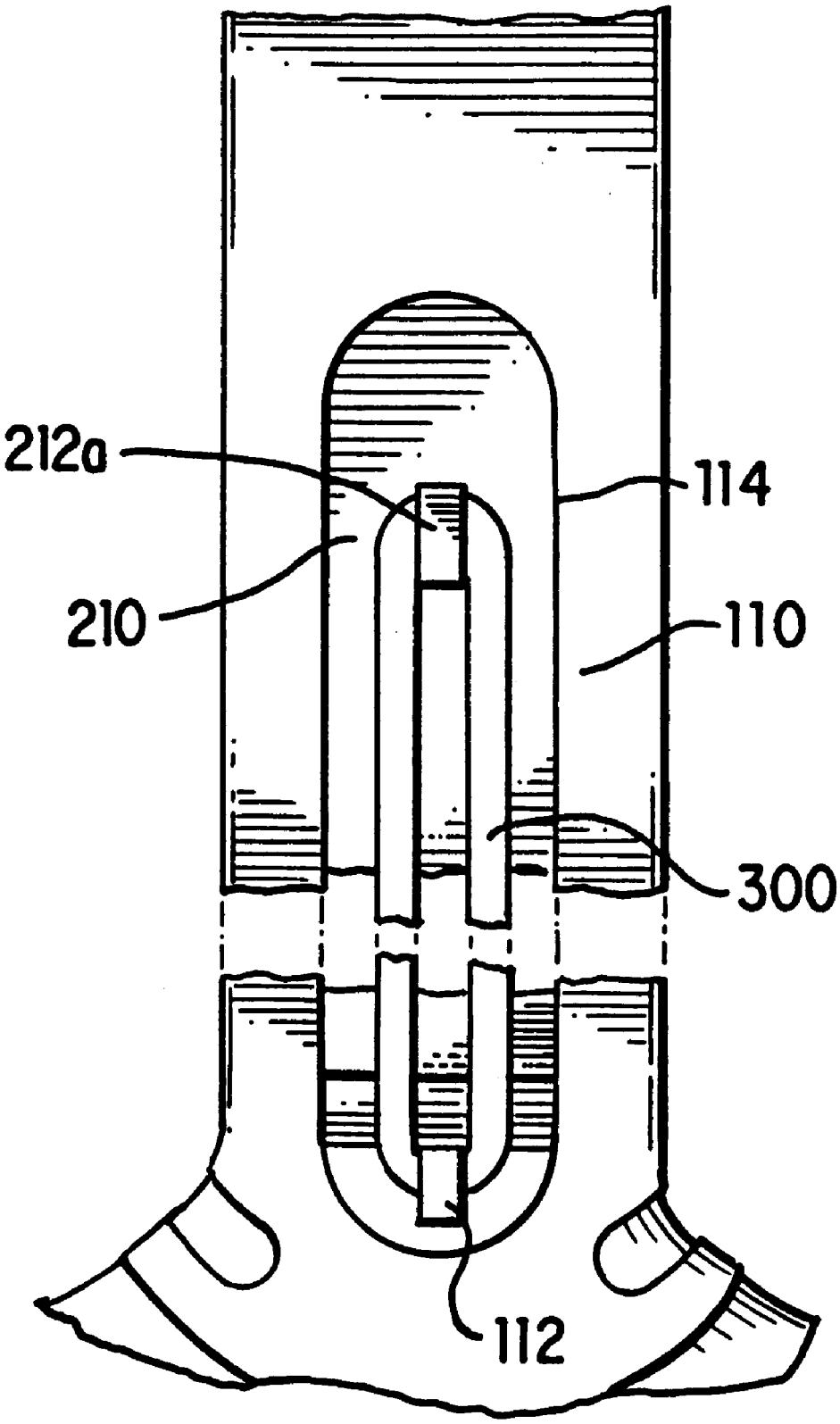

Turning next to FIGS. 3–5, there are shown front elevational views of the subject gluteal exercise system 10 corresponding, respectively, to the perspective views shown in FIGS. 1-2 and a closeup view of the coupling and tension mechanism employed therein. When a displacement force is imparted to the upper and lower body sections 200, 100 by user 1 lifting his or her pelvis from the underlying surface, a resistive force is generated by a resilient tension member which, preferably, is realized in the form of a bungee cord or elastic band 300 connecting the upper body section 200 to the lower body section 100. A plurality of hook members **212*a*–212*c* are formed on the coupling portion 210 of the upper body section 200 to serve as anchoring mechanisms for this elastic band 300; and, at least one corresponding hook member 112 is formed at the base 105 of the tubular sleeve 110**.

The tubular sleeve 110 is provided with an access slot 114 such that at least one of the hook members **212*a*–212*c* may be selectively accessed therethrough for operational engagement by one portion of the elastic band 300. The other portion of the elastic band 300 is engaged with a hook member 112 formed on the lower body section 100**.

When the user lifts his or her pelvis from the supporting surface, as shown by directional arrows 60, 60', the upper body section 200 is lifted accordingly, as indicated by directional arrows 70, 70', by the corresponding upward movement of the user's thighs. Consequently, the elastic band 300 resiliently expands, providing continual resistance to the displacement during its expansion. Upon the user's lowering of his or her pelvis back onto the underlying surface, the upper body section 200 follows the concurrent lowering of the user's thighs, being pulled back towards the lower body section 100 by the elastic band 300.

The upper body section 200 has formed at the base of its central portion 205 a stop 214 which serves to limit the insert of the coupling portion 210 into the tubular sleeve 110 of the lower body section 100. Preferably, stop 214 is integrally formed as an outwardly-protruding rim of the central portion 205. It should be recognized, however, that the displacement limiting function served by stop 214 may be realized by other means—for instance, by simply allowing the lower free end of the coupling portion 210 to abut and come to rest on an opposing internal surface of the tubular sleeve 110 of the lower body section 100. It should also be recognized that, in an alternate embodiment, stop 214 may be formed as a discrete component provided with suitable means for adjusting and releasably locking its position relative to the coupling portion 210 of the upper body section 200. A readily accessible means for adjusting the rest position of the upper body section 200 relative to the lower body section 100 would thus result.

To ensure that substantially all components of resistive force generated by the elastic band member 300 directly oppose the linear displacement of the upper body section 200 away from the lower body section 100, and to thereby ensure that the muscles of the user's gluteal region perform most of the work required to effect such displacement; it is necessary that a substantial length of the coupling portion 210 remain within the tubular sleeve member 110 during the entire range of exercise movement. Any 'buckling' in the substantially colinear coupling arrangement of the coupled portions 110 and 210 would not only degrade the efficiency of the exercise performed, it would not permit smooth progression of the exercise. Of course, the precise length of the coupling portion 210 required to remain within the sleeve member 110 will vary with the lateral clearance between the outer surfaces of the portion 210 and the inner surfaces of the sleeve member 110; however, the variation in the minimum length so required will be marginal if the cross sectional contours and dimensions of the coupling portion 210 and the sleeve member 110 are set according to the teachings of this invention.

Bearing in mind that the physical condition of various users 1 may vary dramatically, it is important that a means for adjusting the tension provided by the elastic band member 300 be simply and quickly adjustable. Accordingly, a plurality of longitudinally separated hook members 212*a*–212*c* are provided along the length of the coupling portion 210. Depending on the desired tension, a user may then adjust the gluteal exercise system 10 to suit his or her specific needs by simply disengaging the elastic band member 300 from the hook member 212*a* and re-engaging it with one of the other hook members 212*b*, 212*c*. Access slot 114 provides convenient access to the user for this purpose. Note that in an alternate embodiment, a plurality of hook members 112 may be provided along the length of the sleeve member 110 for this same purpose either in addition to or in lieu of the plurality of foot members 212 provided along the length of the coupling portion 210. Note also that a further degree of adjustability may be provided by making available one or more additional elastic band members 300' having predetermined dimensions and elasticity with which the existing elastic band member may either be replaced or supplemented.

As the hook members 212*a*–212*c* protrude from an otherwise planar face of the coupling portion 210, a pair of spacing ribs 211, 211' are provided. The spacing ribs 211, 211' project sufficiently from the front surface of the coupling portion 210 and extend a sufficient length longitudinally along that surface to maintain adequate clearance between the hook members 212*a*–212*c* and the opposing internal surface of the sleeve member 110 during the full displacement range of the coupling portion 210 relative to the sleeve member 110. The spacing ribs 211, 211' thus serve to prevent the hook members 212 from 'catching' during use of the exercise device 10 the internal edges of the sleeve member 110 which define the access slot 114. The spacing ribs 211, 211' also serve to minimize the frictional coupling between the coupling portion 210 and the sleeve member 110 by minimizing the contact surface area therebetween without significantly compromising the mechanical stability of their coupling. Indeed, one or more additional spacing ribs (not shown) may also be formed along the rear and side surfaces of the coupling portion 210 to further minimize the contact surface area.

The means for providing functional adjustability discussed above provides also a structural adjustability or re-configurability for adapting to the specific bodily dimensions of a given user 1. The degree to which the elastic band member 300 is initially stretched between hook members 112 and 212 determines the magnitude of force that must be initially generated by the user 1 to displace the upper body section 200 from the lower body section 100. Users with longer limbs, then, will often encounter a greater threshold of force to begin such displacement of the upper section 200 than those users with shorter limbs, since the initial displacement of the upper body section 200 from the lower body section 100 (in the rest position) would be greater. This may be very simply compensated for by the adjustment means provided in the subject gluteal exercise system 10. The elastic band member 300 may be decoupled from one hook member 212*a* and re-coupled, as necessary, to one of the other hook members 212*b*, 212*c* spaced closer to the lower body section member 112.

Referring now to the tension mechanism realized in the preferred embodiment as an elastic band member 300, such is preferably formed of a strong, resilient and durable rubber material. It may be formed, alternatively, as a band of any other suitably resilient material of comparable strength, durability. It may also be formed in other alternate embodiments of components which are not themselves each formed of resilient material, but are assembled to form an effectively resilient structure. In any case, the measure of effective resilience required of such a tension member will be determined by the specifics of the intended application.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A gluteal exercise system for imparting a resistive force responsive to a force applied by a user comprising:

(a) a first body section having a first coupling portion and engagement means extending therefrom for concurrently engaging the feet of the user;

(b) a second body section displaceably coupled to said first body section, said second body section having a second coupling portion and engagement means extending therefrom for concurrently engaging portions of the user's legs, said first and second coupling portions being telescopically coupled together about a longitudinal displacement axis; and, (c) tension means adjustably coupled to said first and second coupling portions for imparting said resistive force in opposition to a force imparted by the user to displace said first and second body sections relative to one another, said tension means including at least one elastic member releasably coupled to said first and second coupling portions, said first body section having formed thereon at least one anchoring means for releasable engagement by said elastic member, said second body section having formed thereon a plurality of anchoring means for releasable engagement by said elastic member, said anchoring means of said first and second body sections being disposed in a longitudinally aligned manner, said first coupling portion being formed as a substantially tubular sleeve member telescopically receiving said second coupling portion, said sleeve member having formed therein an access slot, whereby the user may access a selected one of said second body section anchoring means while said second coupling portion remains telescopically received within said first coupling portion.

2. A portable exercise system for exercising a gluteal region of a user's anatomy comprising:

(a) a substantially T-shaped first body section having a longitudinally extended first coupling portion and a pair of bar members extending transversely therefrom;

(b) a substantially T-shaped second body section displaceably coupled to said first body section, said second body section having a longitudinally extended second coupling portion and a pair of arcuate arm members extending transversely therefrom for concurrently engaging portions of the user's legs, said first and second coupling portions being telescopically coupled together; and, (c) tension means connecting said first and second coupling portions, said tension means resiliently biasing said first body section against displacement relative to said second body section in a predetermined direction, said tension means including at least one elastic member releasably coupled to said first and second coupling portions, said first body section having formed thereon at least one anchoring means for releasable engagement by said elastic member, said second body section having formed thereon a plurality of said anchoring means for releasable engagement by said elastic member, said anchoring means of said first and second body sections being disposed in a longitudinally aligned manner, said first coupling portion being formed as a substantially tubular sleeve member telescopically receiving said second coupling portion, said sleeve member having formed therein an access slot, whereby said user may access a selectable one of said second body section anchoring means while said second coupling portion remains telescopically received within said first coupling portion.

3. A portable exercise system for exercising a gluteal region of a user's anatomy comprising:

(a) a substantially T-shaped first body section having a longitudinally extended first coupling portion and a pair of bar members extending transversely therefrom, said first coupling portion including a substantially tubular sleeve member having an access slot formed therein;

(b) a substantially T-shaped second body section displaceably coupled to said first body section, said second body section having a longitudinally extended second coupling portion and a pair of arcuate arm members extending transversely therefrom for concurrently engaging portions of the user's legs, said second coupling portion being telescopically inserted into said first coupling portion sleeve member; and, (c) tension means for resiliently connecting said first and second coupling portions, said tension means longitudinally biasing said first and second coupling portions one towards the other.

4. The portable exercise system as recited in claim 3 wherein said tension means includes at least one elastic member releasably coupled to said first and second coupling portions.

5. The portable exercise system as recited in claim 4 wherein each of said first and second body sections has formed thereon at least one anchoring means for releasable engagement by said elastic member, said anchoring means of said first and second body sections being disposed in longitudinally aligned manner.

6. The portable exercise system as recited in claim 5 wherein said second body section has formed thereon a plurality of said anchoring means, said anchoring means being disposed thereon in longitudinally aligned manner.

7. The portable exercise system as recited in claim 6 wherein each of said second body section anchoring means is formed as a hook member on said second coupling portion, each said hook member being selectively accessible through said access slot of said first coupling portion.

* * * * *